US006648707B1

(12) United States Patent
Peterson

(10) Patent No.: US 6,648,707 B1
(45) Date of Patent: Nov. 18, 2003

(54) PROTECTIVE COVER FOR AN INFLATABLE TOWABLE VEHICLE

(75) Inventor: Leroy L. Peterson, Omaha, NE (US)

(73) Assignee: Sportsstuff, Inc., Omaha, NE (US)

( * ) Notice: Subject to any disclaimer, the term of this patent is extended or adjusted under 35 U.S.C. 154(b) by 0 days.

(21) Appl. No.: 10/164,476

(22) Filed: Jun. 6, 2002

(51) Int. Cl.[7] ..... B63B 1/00

(52) U.S. Cl. ..... 441/66; 441/67; 441/131; 114/345; 114/361

(58) Field of Search ..... 114/345, 346, 114/348, 361, 363; 441/40, 41, 65, 66, 67, 129, 130, 131, 132; 280/18, 18.1; 472/128, 129

(56) References Cited

U.S. PATENT DOCUMENTS

| | | | | | |
|---|---|---|---|---|---|
| 1,332,673 | A | * | 3/1920 | Marshall | 441/129 |
| 2,018,548 | A | * | 10/1935 | Currey | 441/66 |
| 2,036,548 | A | * | 4/1936 | Silvernail | 441/66 |
| 2,075,374 | A | * | 3/1937 | Tucker | 441/131 |
| 2,683,270 | A | * | 7/1954 | Long | 441/40 |
| 2,876,467 | A | * | 3/1959 | Lund | 441/40 |
| 3,336,613 | A | * | 8/1967 | Wales | 441/42 |
| 3,490,085 | A | * | 1/1970 | Lewis | 114/345 |
| 3,628,206 | A | * | 12/1971 | Mecham | 280/18.1 |
| 3,653,084 | A | * | 4/1972 | Hartman | 441/40 |
| 3,748,671 | A | * | 7/1973 | Dunsmet | 114/345 |
| 3,871,042 | A | * | 3/1975 | Farmer | 114/346 |
| 4,159,551 | A | * | 7/1979 | Iwai | 114/345 |
| 4,159,826 | A | * | 7/1979 | Hancock | 482/26 |
| 4,366,963 | A | * | 1/1983 | Reeves et al. | 280/18.1 |
| 4,552,539 | A | * | 11/1985 | Hoenstine et al. | 441/66 |
| 4,619,620 | A | * | 10/1986 | Felter | 441/66 |
| 4,635,581 | A | * | 1/1987 | Scheurer | 114/346 |
| 4,667,618 | A | * | 5/1987 | Cigognetti | 114/345 |
| 4,732,399 | A | * | 3/1988 | Reilly et al. | 280/18.1 |
| 5,006,087 | A | * | 4/1991 | Peterson | 441/66 |
| 5,122,086 | A | * | 6/1992 | Remy | 441/66 |
| 5,279,510 | A | * | 1/1994 | Remy | 441/67 |
| 5,383,804 | A | * | 1/1995 | Mitch et al. | 441/66 |
| 5,564,357 | A | * | 10/1996 | Peterson | 114/345 |
| 5,613,459 | A | * | 3/1997 | Remy | 114/55.5 |
| 5,617,808 | A | * | 4/1997 | Robinson | 114/123 |
| 5,713,773 | A | * | 2/1998 | Churchill | 441/66 |
| 6,066,016 | A | * | 5/2000 | Yonover | 441/40 |
| 6,223,678 | B1 | * | 5/2001 | Haller et al. | 114/347 |
| 6,368,171 | B1 | * | 4/2002 | Fuller et al. | 441/40 |

FOREIGN PATENT DOCUMENTS

| | | | | |
|---|---|---|---|---|
| GB | 1445191 A | * | 8/1976 | B63B/7/08 |
| WO | WO 200152955 A1 | * | 7/2001 | A63C/5/00 |

* cited by examiner

*Primary Examiner*—S. Joseph Morano
*Assistant Examiner*—Ajay Vasudeva
(74) *Attorney, Agent, or Firm*—Sturm & Fix LLP

(57) ABSTRACT

An inflatable towable vehicle including an inflatable bladder and a protective shell having a rigid lower portion and a flexible upper portion. The bladder includes an inflation valve that is positioned to underlie a closeable access opening in the flexible upper portion of the shell, and hand grips and a towing strap are attached to the upper portion of the shell. The rigid lower portion of the shell is made of a durable material that effectively protects the bladder in abrasive environments that are present when the vehicle is used on ice or snow.

5 Claims, 1 Drawing Sheet

PROTECTIVE COVER FOR AN INFLATABLE TOWABLE VEHICLE

BACKGROUND OF THE INVENTION

1. Field of the Invention

The present invention relates to the field of inflatable recreational devices, and more particularly to an inflatable towable vehicle for use on water or snow.

2. Description of Related Art

Inflatable towable vehicles for recreational water or snow use include many structures and designs ranging from the simple to the complex. Many of these structures include protective shells for inflatable bladders. The protective shell, however, may be damaged by use, particularly on snow or ice where contact with the surface presents an abrasive environment.

As a consequence of the foregoing situation, there has existed a longstanding need for a new and improved inflatable towable vehicle with a protective shell that is durable, and the provision of such a construction is a stated objective of the present invention.

BRIEF SUMMARY OF THE INVENTION

Briefly stated, the present invention provides an inflatable towable vehicle including an inflatable bladder and a protective shell having a rigid lower portion and a flexible upper portion. The bladder includes an inflation valve that is positioned to underlie a closeable access opening in the flexible upper portion of the shell, and hand grips and a towing strap are attached to the upper portion of the shell. The rigid lower portion of the shell is made of a durable material that effectively protects the bladder in abrasive environments that are present when the vehicle is used on ice or snow.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
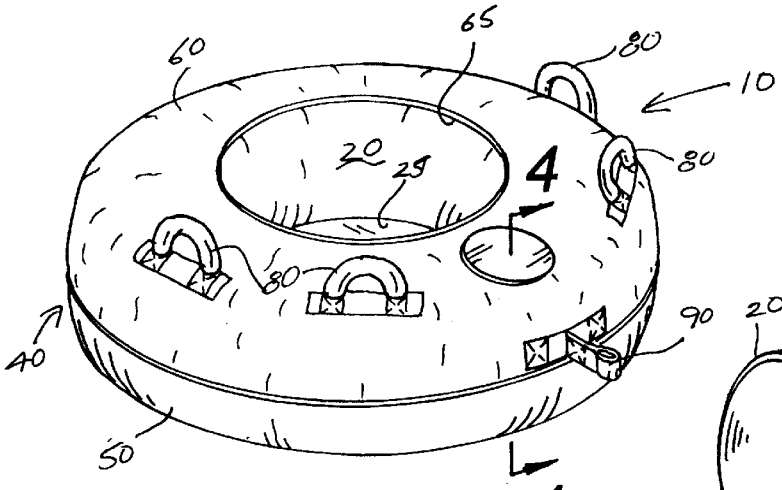
FIG. 1 is a perspective view of the inflatable towable vehicle of the present invention.

As can be seen by reference to the drawings, and in particular to FIG. 1, the inflatable towable vehicle that forms the basis of the present invention is designated generally by the reference number 10.

The vehicle 10 includes a ring shaped inflatable bladder 20 having a central opening 25 and an inflation valve 30. The bladder 20 is matingly received in a protective shell 40 that has a rigid lower portion 50 and a flexible upper portion 60 with a top opening 65. The flexible upper portion 60 also has an access opening 67 with a closeable flap 70 that overlies the inflation valve 30, a number of hand grips 80, and a towing strap 90.

The bladder 20 may be made of polyvinylchloride or other suitable materials. The lower portion 50 of the shell 40 is made of a rigid durable material such as molded polyethylene, and the flexible upper portion 60 may be made of a durable fabric such as nylon.

Figure 3:
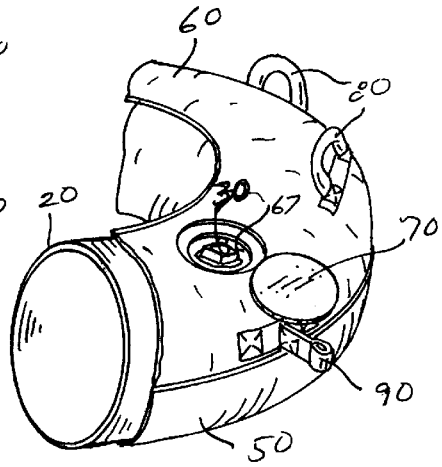
FIG. 3 is a partial perspective view illustrating the inflated bladder matingly received in the shell.
Figure 2:
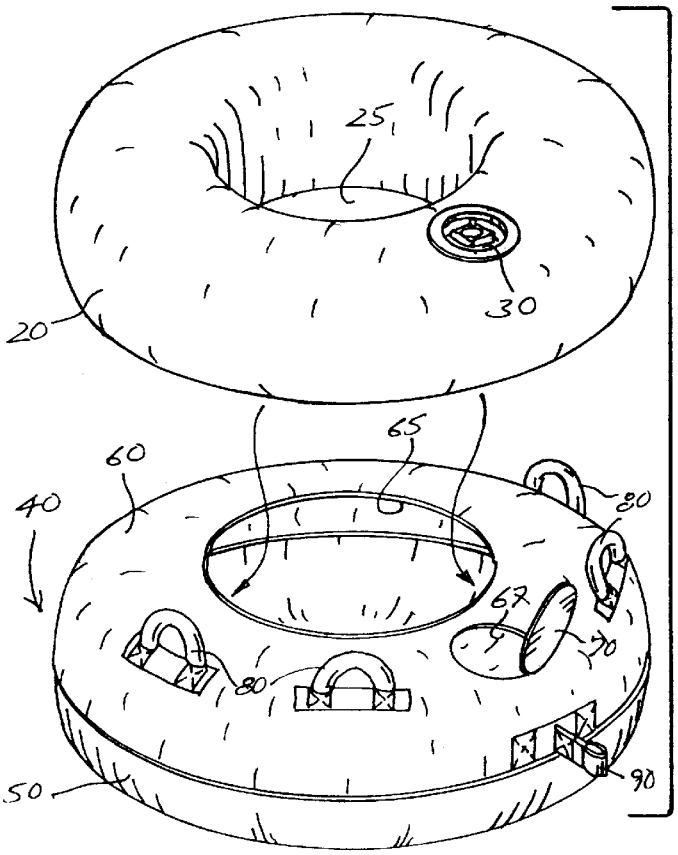
FIG. 2 is an exploded perspective view showing the inflatable bladder and the protective shell.
Figure 4:
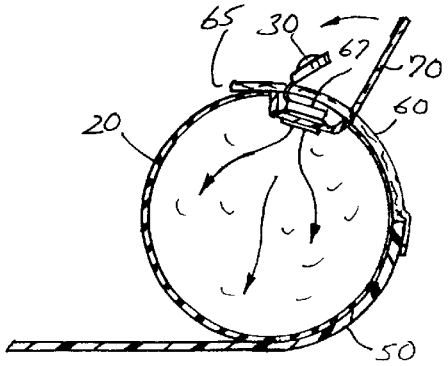
FIG. 4 is a sectional view taken along line 4—4 of FIG. 1.

In use, the bladder 20 is positioned in the shell 40 so that the inflation valve 30 is in registry with the access opening 70. The bladder 20 is then fully inflated so that it is matingly received in the shell 40 as best illustrated in FIGS. 3 and 4. The rigid lower portion 60 of the shell 40 underlies and extends up around the outer periphery of the bladder 20 to provide a durable protective shield against abrasive conditions that may be present when the vehicle 10 is used on snow or ice. The flexible upper portion 60 provides a softer surface that the passengers of the vehicle 10 come in contact with.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An inflatable towable vehicle, comprising:

an inflatable bladder having an inflation valve;

a protective shell-sized to matingly receive the inflatable bladder when it is inflated, the shell including a rigid lower portion and a flexible upper portion wherein the inflation valve is positioned on a topside of the bladder to underlie the flexible upper portion of the shell; and wherein the flexible upper portion of the shell includes a closeable access opening positioned over the inflation valve of the bladder.

2. The inflatable towable vehicle of claim 1 wherein the bladder is ring shaped and includes a central opening, and wherein the flexible upper portion of the shell includes a top opening disposed over the central opening.

3. The inflatable towable vehicle of claim 2 wherein the inflation valve is positioned on the bladder to underlie the flexible upper portion of the shell.

4. The inflatable towable vehicle of claim 1 further including a plurality of hand grips attached to the flexible upper portion of the shell.

5. The inflatable towable vehicle of claim 1 further including a towing strap attached to the flexible upper portion of the shell.

* * * * *